United States Patent [19]

Loer

[11] Patent Number: 4,717,286

[45] Date of Patent: Jan. 5, 1988

[54] ANTI-SCOUR APPARATUS AND METHOD

[75] Inventor: Kenneth H. Loer, Katy, Tex.

[73] Assignee: Gulf Applied Technologies, Inc., Houston, Tex.

[21] Appl. No.: 543,070

[22] Filed: Oct. 21, 1983

Related U.S. Application Data

[63] Continuation-in-part of Ser. No. 440,666, Nov. 10, 1982, abandoned.

[51] Int. Cl.[4] ..... E02B 3/04

[52] U.S. Cl. ..... 405/74; 405/15; 405/25; 405/211

[58] Field of Search ..... 405/15, 21, 25, 30, 405/34, 35, 74, 211

[56] References Cited

U.S. PATENT DOCUMENTS

| | | | |
|---|---|---|---|
| 2,731,799 | 1/1956 | Lange et al. | 405/35 |
| 2,870,609 | 1/1959 | Siebenhausen, Jr. et al. | 61/46.5 |
| 3,859,803 | 1/1975 | Pedersen et al. | 405/211 |
| 4,019,332 | 4/1977 | Lamy | 405/211 |
| 4,036,022 | 7/1977 | Larsen | 405/74 |
| 4,114,394 | 9/1978 | Larsen | 405/211 X |
| 4,220,421 | 9/1980 | Thorne | 405/211 |
| 4,279,545 | 7/1981 | De Werk | 405/211 |
| 4,341,489 | 7/1982 | Karnas | 405/35 |

FOREIGN PATENT DOCUMENTS

| | | |
|---|---|---|
| 877057 | 9/1961 | United Kingdom . |
| 1302531 | 1/1973 | United Kingdom . |
| 1383012 | 2/1975 | United Kingdom . |

*Primary Examiner*—David H. Corbin
*Attorney, Agent, or Firm*—Alton W. Payne

[57] ABSTRACT

An anti-scour apparatus and method for preventing, reducing or repairing scour in the vicinity of a structure extending vertically from the floor beneath a body of moving water. The anti-scour apparatus comprises one or more deflectors, a spacer for maintaining the positional relationship of the deflectors and for maintaining the positional relationship of the deflectors and the floor beneath the body of water, and a plurality of hydraulic trips operatively associated with the structure. The method for preventing scour including the steps of deflecting a downwash at a location adjacent the structure and above the floor, deflecting a downwash at a location adjacent the structure and adjacent the floor, inducing the turbulent flow of water adjacent the structure, and capturing the suspended sediment for filling prior scour. Additionally, the invention comprises a kit of parts preferably comprising as cooperative parts thereof an upper deflector, a lower deflector, a sleeve movably and removably engaged with the structure, means for securing the deflectors to the sleeve, and a plurality of hydraulic trips associated with the sleeve.

38 Claims, 12 Drawing Figures

60
2
4
20
22
24

4
61
60
62
8
6
VELOCITY
64
68
DEPTH
66
70
63
26
20
24

P=ø
76
76
78
78
8
80
6
74
73
62
P=ø

ANTI-SCOUR APPARATUS AND METHOD

CROSS REFERENCE TO RELATED APPLICATION

The present application is a continuation-in-part application of the application to Kenneth H. Loer, U.S. Ser. No. 440,666, filed Nov. 10, 1982, now abandoned, entitled Anti-Scour Protector.

FIELD OF THE INVENTION

The present invention relates generally to fluid transport phenomena. Specifically, the present invention relates to a method and an anti-scour apparatus for preventing the transport of material from the vicinity of structures in a fluid flow.

BACKGROUND OF THE INVENTION

The phenomenon of scour, i.e., to clear or remove by a current of fluid, is a well known problem associated with structures supported in bodies of moving water. Scouring mechanisms are present around and associated with any secured structure in the path of a moving fluid. Scour is especially important when trying to maintain the structural integrity of gravity supported structures embedded in a sediment floor beneath a body of moving water.

The scour of sediment from around structures embedded in the floor beneath a body of moving water is a difficult problem. Scour is encountered when the following criteria exist a moving fluid, a relatively fixed structure and a movable material associated with the structure. Scour is the progressive removal of the material from around or underneath the structure.

Specifically, the scouring process is effective on any material associated with an object in the path of a moving fluid. Scour is a universal phenomenon that is often seen or experienced. For example, any person who stands on a beach and allows the water to pass around and by his feet to dislodge the sand from around and under his feet is experiencing scour.

Commercially, scour is a critical problem in many offshore areas where large, heavy structures such as offshore drilling and production platforms must be supported from the floor beneath the ocean. Likewise, scour is a critical factor in designing stanchions that support bridges spanning rivers or other bodies of moving water. Scouring critically reduces the support supplied to a gravity supported structure.

It is well known to retard the scouring process by using sand bags to refill the holes caused by the removed material. Even the relocation of the structure has proven to be economically feasible to circumvent excessive scouring problems.

More recently, numerous and varied methods of preventing or retarding scouring have been utilized. A screen-mesh material has been used to cover the floor around a structure beneath the body of water. Screen-mesh material has proven helpful in the immediate vicinity of the structure, but has caused excessive scour to a larger region about the screen-mesh material. Alternate methods of preventing scour have included the implantation of more dense material about the structure. Examples of material used is concrete and asphalt. The implantation methods have resulted in even more acute scouring problems depending on the depth and width of the implant. It is even common practice in many offshore areas with large structures that exhibit significant scouring to use commercial divers. The divers move along the floor beneath the body of water using devices that blow the bottom sediment from an adjacent area into the holes around the structures caused by scour.

All of the presently known or used devices and methods for preventing, reducing or repairing scour address the effects of the scouring process. The devices and methods, some of which are discussed above, are merely engineering techniques that have been developed to deal with a common and universal problem. None of the discussed devices or methods seeks to address the cause of scouring.

Numerous and varied factors can enhance the scouring phenomenon. Of significant importance is the consistency of the material in which the structure is embedded. A sea bed consisting of non-cohesive material is extremely susceptible to scouring forces. Thus, a floor beneath a body of water that consists substantially of silty material, sand or gravel is highly susceptible to the scouring process. The scouring process is enhanced by the presence of such non-cohesive material, since scouring requires the disengagement, suspension and movement of the floor sediments.

Another critical parameter associated with the scouring process is the current velocity of the fluid. There exists a critical current velocity associated with, but not exclusive of, the geometry of the structure and the material or sediment to be transported. Thus, a critical current velocity required to initiate scour can be expressed as a function of the following parameters: the geometric shape of the structure, the size of the sediment material to be transported, the density of the sediment material to be transported and the shape of the sediment material to be transported.

Scour can adversely effect the structural stability of any object around which the phenomenon takes place. For example, a stanchion embedded in non-cohesive sediment beneath a body of moving water will experience significant scour around the stanchion. As the sediment is removed from around the stanchion, the cross-sectional area of the stanchion exposed to the force delivered by the flow of water is increased. An increase in the encountered cross-sectional area provides an increase in the total force adverse to the stability of the stanchion.

Similarly, as the sediment is removed from around the stanchion, the effective contact area of the floor sediment with the structure decreases. The effective contact area of the floor sediment with the structure is directly proportional to the force required to dislodge the structure. As the effective contact area decreases, the force required to be exerted on the structure by the water impacting thereupon is also reduced. Therefore, the stability of the structure is reduced since the structural support provided by the floor sediment in contact with the structure has been reduced.

As the scour phenomenon proceeds and floor sediment is removed, an additional consideration is the shift in the fulcrum about which the stanchion pivots. The fulcrum point for a gravity supported structure embedded in non-cohesive sediment would typically be at some location in the sediment below the sediment-water interface. A small change in the location of the fulcrum causes a change in the lever arm distances associated with the system and causes a significant change in the forces related to the securement and the dislodgement of the stanchion. A small change in the lever arm distances, dramatically changes the relative magnitudes of the forces. Thus, the force associated with the current instigating dislodgement is dramatically increased and the force associated with the floor sediment maintaining securement of the stanchion is dramatically decreased. Therefore, the amount of and the rate of scour is extremely important for the stability of any structure embedded in material beneath a body of moving water.

There is thus a need for an anti-scour apparatus which can be associated with a structure embedded in material beneath a body of moving fluid, which, at the same time, provides superior structural integrity, which is readily built into a new structure or assembled and installed on an old structure, and which is exceedingly less expensive than all prior known devices and methods.

It is, therefore, a feature of the present invention to provide a unique anti-scour apparatus and method for implementation with structures embedded in the floor beneath a body of moving water.

It is a more particular feature of the present invention to provide an anti-scour apparatus and method to manipulate and control the transport mechanisms associated with the movement of material around a structure in a fluid flow.

Another feature of the present invention is to provide an anti-scour apparatus and method for controlling the flows that cause scour.

Yet another feature of the present invention is to prevent the impingement, on the sediment material supporting a structure, of the downwash associated with the impact of moving water on the structure.

Yet still another feature of the present invention is to provide an antiscour apparatus and method that reduces the size of the separation of the fluid flow associated with a structure, thereby reducing the wake downstream of the structure.

A further feature of the present invention is to provide an antiscour apparatus and method for delaying the separation of the fluid flow which reduces the magnitude of the drag on the structure.

Still further a feature of the present invention is to provide an anti-scour apparatus and method to prevent the impact of a downwash, associated with a fluid flow and a structure therein, on the bottom sediment preventing a transfer of energy from the downwash to the sediment.

Still further a feature of the present invention is to provide an anti-scour protector and method to prevent, downstream of a structure in a moving fluid, the filling of the wake with and being the transport mechanism for bottom sediment.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

In accordance with the present invention, a unique anti-scour apparatus and method are provided for preventing, reducing or repairing scour in the vicinity of a structure extending vertically from the floor beneath a body of moving water. In one embodiment of the invention, an anti-scour apparatus is provided comprising one or more deflectors, means for maintaining the positional relationship of the deflectors between each adjacent deflector and between each deflector and the floor beneath the body of water, and a plurality of hydraulic trips operatively associated with the structure.

It is preferable that the anti-scour apparatus comprises two deflectors: an upper deflector and a lower deflector. Both deflectors are preferred to be circular plates having an aperture in the center through which the structure extends. The lower deflector engages the floor beneath the body of water and the upper deflector maintains a spaced relationship with the lower deflector.

Preferably, the lower deflector has a plurality of perforations. The perforations in the lower deflector capture mobile floor sediments passing above the surface of the lower deflector. The captured floor sediment falls through the perforations and fills any voids beneath the lower deflector caused by prior scour.

It is preferable that the means for maintaining the positional relationship of the deflectors and the floor comprises a sleeve having an inner surface configured to embrace the structure, an outer surface, an upper orifice and a lower orifice. The inner surface of the sleeve is movably and removably engaged with the structure. A deflector is secured to each end of the sleeve by any conventional attachment means.

Also, preferably, a plurality of hydraulic trips are associated with the structure. The hydraulic trips comprise a series of ridges aligned longitudinally on the sleeve.

In accordance with another embodiment of the present invention, a method is provided for preventing, reducing or repairing scour in the vicinity of a structure extending vertically from a floor beneath a body of moving water by a series of steps. First, at a location adjacent the structure and above the floor, a downwash caused by the impact of the water on the structure is deflected to disassociate the flow structure of the downwash. Second, at a location adjacent the structure and adjacent the floor, the downwash caused by the impact of the water on the structure is deflected precluding the impact of the downwash on the floor. Third, mobile floor sediment is captured for filling the voids caused by prior scour in the vicinity of the structure. And fourth, the water passing adjacent the structure is hydraulically tripped for delaying the separation of the water flow which reduces the magnitude of the drag on the structure and which reduces the size of the wake downstream of the structure thereby enhancing the anti-scour characteristics of the apparatus.

In accordance with yet another embodiment of the present invention, a kit is provided, an assembly of components, the components adapted for assembly together as an anti-scour apparatus for preventing, reducing or repairing scour in the vicinity of a structure extending vertically from the floor beneath a body of water. The components of the kit preferably comprising as cooperative parts thereof: an upper deflector, a lower deflector, a sleeve movably and removably engaged with the structure, means for securing the deflectors to the sleeve and a plurality of hydraulic trips associated with the sleeve.

Preferably, the upper and lower deflectors are circular plates having an aperture at their center through which the structure extends. The lower plate is placed on the floor beneath the body of water and the upper plate is held at a distance from the lower plate by the sleeve. The deflectors are secured to the sleeve by any conventional attachment means.

The plurality of hydraulic trips consist essentially of a series of ridges running longitudinally along the outer surface of the sleeve. The hydraulic trips cause the water flow adjacent the sleeve to be turbulent. The turbulence delays the separation of the water flow which reduces the magnitude of the drag on the structure and which reduces the size of the wake downstream of the structure thereby enhancing the anti-scour characteristics of the apparatus.

BRIEF DESCRIPTION OF THE DRAWINGS

The accompanying drawings, which are incorporated into and constitute a part of the specification, illustrate a preferred embodiment of the invention and, together with the general description of the invention given above, and the detailed description of the preferred embodiment given below, serve to explain the principles of the invention.

The above general description and the following detailed description are merely illustrative of the generic invention, and additional modes, advantages and particulars of this invention will be readily suggested to those skilled in the art by the following detailed description.

DETAILED DESCRIPTION OF THE PREFERRED EMBODIMENTS

Reference will now be made in detail to a presently preferred embodiment of the invention as illustrated in the accompanying drawings.

Figure 1:
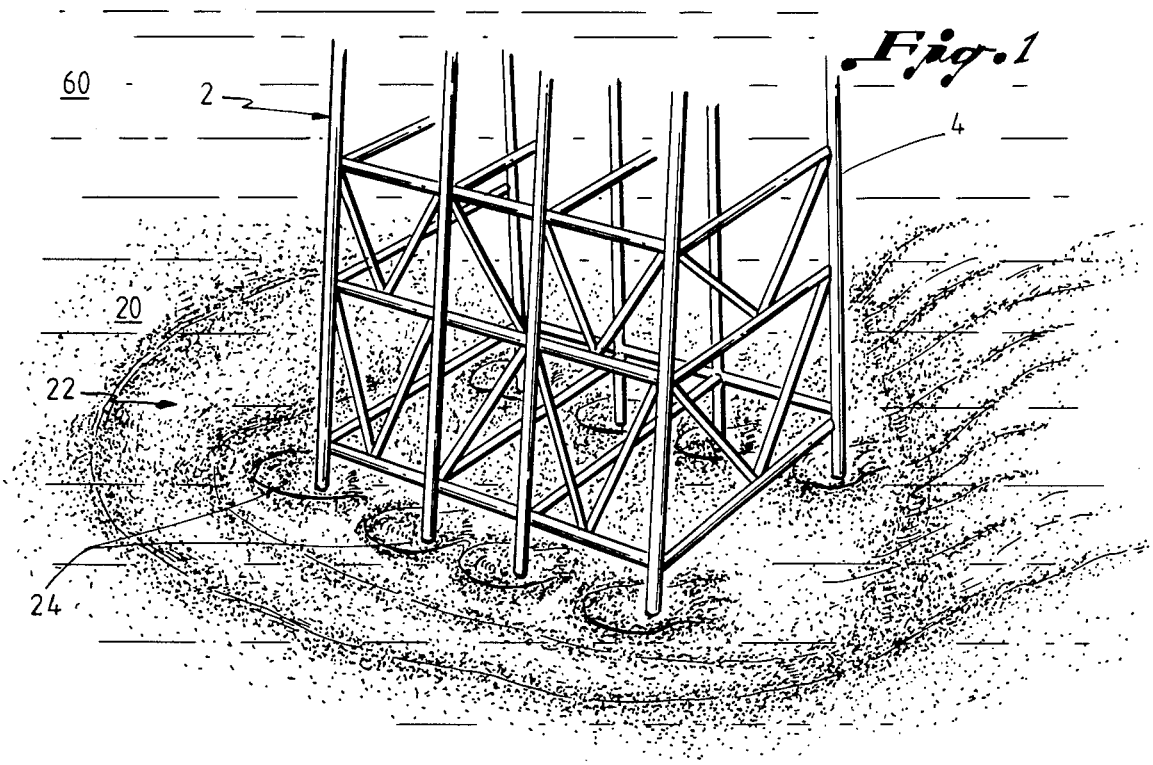
FIG. 1 is a perspective view of a conventional offshore structure illustrating the effects of general scour and local scour.

In FIG. 1, there is shown a perspective view of a conventional offshore structure 2. The offshore structure 2 has a plurality of support structures 4. The support structures 4 extend vertically into the floor 20 beneath a body of water 60. The offshore structure 2 is a gravity supported structure secured by the support structures 4 being embedded in the loose soils of the floor 20.

Generally, large complicated structures such as the offshore structure 2 exhibit two types of scour. The two types of scour are general scour and local scour. General scour and local scour are illustrated in FIG. 1 by reference numerals 22 and 24, respectively. General scour 22 shows the removal of floor sediment 20 in the entire vicinity of the offshore structure 2. Local scour 24 shows the removal of floor sediment 20 in the vicinity of each support structure 4.

FIG. 1 illustrates the general concepts of scour. Scour can be better conceptualized by considering what the approaching water flow "sees". The approaching flow reacts with impacted objects to cause a specific effect based upon the size of the structure and the energy associated with the flow.

Generally, a flow approaching an object such as the offshore structure 2 will react on a macro-scale and a micro-scale. Thus, the effects of the flow impinging upon the offshore structure 2 will cause effects associated with the major structure 2 and the minor, support structures 4. The characteristics of the flow reacting with the offshore structure 2, in its entirety, cause the general scour 22. The effects of the flow reacting with each individual support structure 4 cause the local scour 24. In each case, whether general scour 22 or local scour 24, the water flow in the vicinity of the offshore structure 2, generally, and the support structure 4, specifically, cause an associated increase in flow velocities around the structure due to the reduced flow area caused by the presence of the respective structures.

Figure 2:
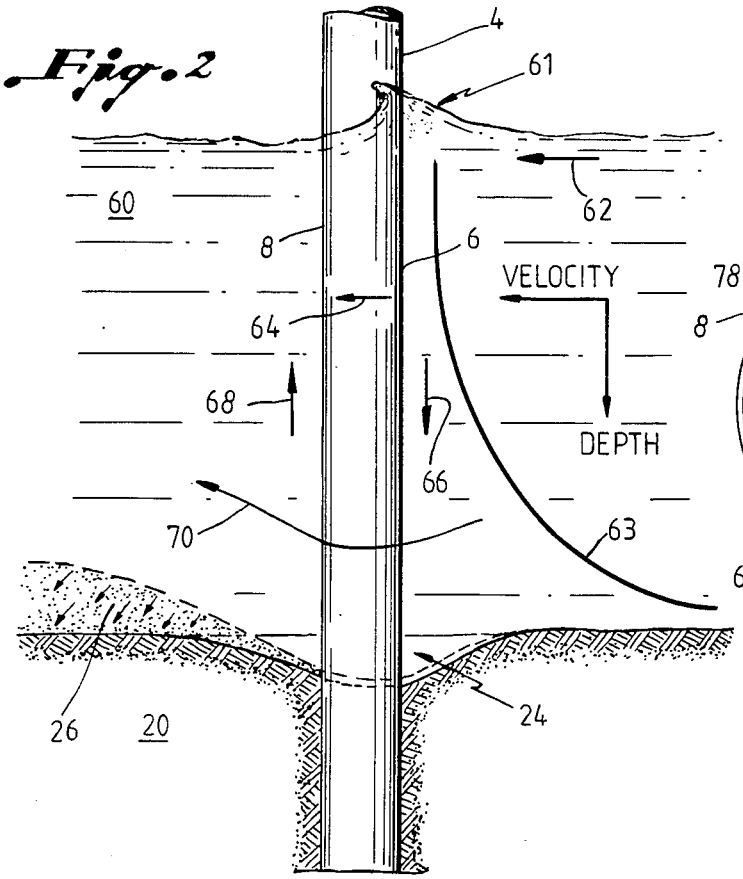
FIG. 2 is a side view of a vertical support structure extending from beneath the floor of a body of water and illustrating the flow characteristics in a plane parallel to the longitudinal axis on the structure.

In FIG. 2 the basic flow characteristics associated with the scouring process are illustrated. A structure 4 is embedded in the loose soils of the floor 20 beneath a body of water 60. An upstream flow 62 impinges upon the exposed cross-sectional area of the structure 4. The upstream flow 62 has a velocity profile 63. The velocity profile 63 exhibits a decrease in velocity with an increase in depth. The physical presence of the structure 4 reduces the flow volume available in which the upstream flow 62 must pass. The restricted volume through which the upstream flow 62 must pass causes a change in the flow characteristics.

The decrease in available volume causes the upstream flow 62 to increase in speed while passing around the structure 4. The increased side velocity 64 is a primary characteristic of the obstruction of the upstream flow 62.

Most significantly, as shown in FIG. 2, when the upstream flow 62 impinges on the structure 4, a downwash 66 is created along and down the front surface of the structure 4. The downwash 66 is primarily caused by the velocity profile 63. The velocity profile 63 expresses the inverse relationship between the depth and the velocity, i.e., in general the velocity decreases with increasing depth. The relationship of the velocity and the depth, as expressed by the velocity profile 63, is concerned with that portion of the body of water 60 where friction forces due to the motion of the upstream flow 62 relative to the floor 20 are of prime importance.

The velocity profile 63 can be expressed by a power-law function and creates a pressure gradient along the upstream side 6 of the structure 4. The pressure at any location along the upstream side 6 is directly proportional to the velocity at any location along the velocity profile 63. Thus, the pressure increases exponentially and the velocity decreases exponentially along the upstream side 6 with respect to depth. The pressure and velocity gradients create a downward path of least resistance along the upstream side 6 of the structure 4. The pressure and velocity gradients create and further enhance the downwash 66. The downwash 66 is the primary cause of the scour hole 24.

After the flow passes around the structure 4 causing the increased side velocity 64, an upwash 68 is created along and up the downstream side 8 of the structure 4. The energy associated with the upwash 68 is much less than the energy associated with the downwash 66. Also, as the flow passes around and by the structure 4, a vortex shedding 70 occurs.

As illustrated in FIG. 2, the downwash 66 is the primary cause of the scour hole 24. Essentially, the entire energy associated with the downwash 66 is brought to bear upon the loose soils of the floor 20. The complete dissipation of energy by the downwash 66 dislodges and suspends significant quantities of the loose soil associated with the floor 20. Thus, at least initially, the scour hole 24 is sufficiently larger and deeper on the upstream side 6 of the structure 4 than on the downstream side 8 of the structure 4.

Figure 3:
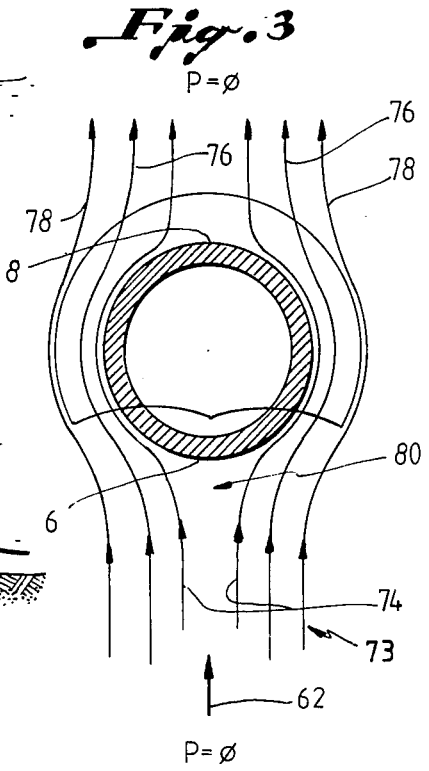
FIG. 3 is a top view of a vertically extending support structure extending from the floor of a body of water and illustrating the flow characteristics in the plane orthogonal to the longitudinal axis of the structure.

FIG. 3 illustrates characteristics of the flow as it passes around and by the structure 4. FIG. 3 shows the flow and pressure characteristics in the plane orthogonal to the longitudinal axis of the structure 4. The upstream flow 62 approaches and impinges upon the structure 4. The flow lines 73 illustrate the path followed by the flow as the flow approaches, impinges, passes around and separates from the structure 4.

The relative velocities are illustrated by the flow lines 73 in FIG. 3. As the upstream flow 62 approaches the structure 4, the cross-stream velocity is constant. The constant cross-stream velocity is indicated by the equal spacing of the flow lines 73 prior to being influenced by the structure 4. As the flow approaches the structure 4, the inner flow lines 74 asymptoticaly approach the structure 4. In a like manner, the inner flow lines 74 and the intermediate flow lines 76 become closer and closer together as do the intermediate flow lines 76 and the outer flow lines 78. The narrowing of the distance between the flow lines 73 indicates an increase in the velocity as the flow passes around the structure 4.

A drastic reduction in longitudinal velocity takes place at the upstream side 6 of the structure 4. The reduction in longitudinal velocity is illustrated in FIG. 3 by the broad gap 80 between the inner flow lines 74. The reduction in longitudinal flow illustrated by the gap 80 is not an indication that the velocity at the interface is zero. Theoretically, the velocity of a moving fluid will decrease exponentially from a maximum value to zero at the fluid-structure interface. The flow lines 73 are not directed to such a small scale analysis. The present flow lines 73 are provided to illustrate and better explain the consequences of the impingement of the upstream flow 62 on the structure 4. The decrease in flow velocity at the upstream side 6 of the structure 4 is a result of this impactment. Thus, on the upstream side 6 of the structure 4, the flow could experience a zero velocity and even a negative velocity relative to the upstream flow 62.

FIG. 3 illustrates the pressure differentials associated with the flow around the structure 4. In the upstream flow 62, the pressure is indicated by $\phi$, i.e., $P=\phi$. As the flow approaches the structure 4, the pressure increases. At a location near or adjacent to the upstream side 6 of the structure 4, the pressure reaches a maximum value ($P>\phi$). As the flow progresses around and adjacent to the structure 4, the pressure decreases to a magnitude less than the original upstream pressure ($P<\phi$). The lowest pressure associated with the flow is at the downstream side 8 of the structure 4. As the flow continues downstream past the structure 4, the pressure returns to the original undisturbed upstream value ($P=\phi$).

Figure 4:
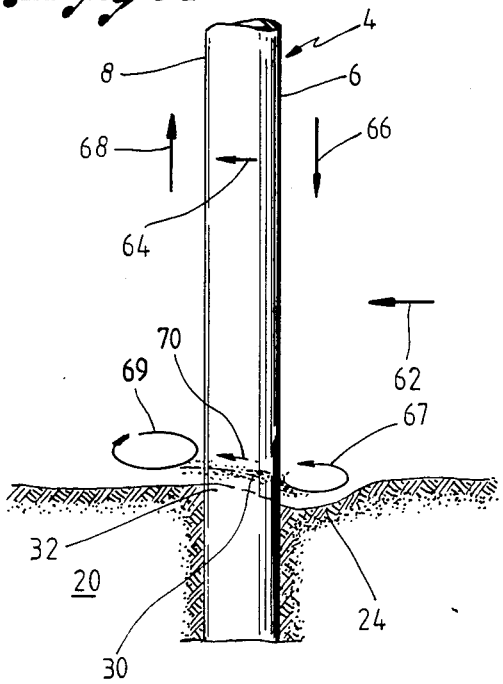
FIG. 4 is an axonometric projection of a side view illustrating the effects of the downwash vortices and the upwash vortices in the vicinity of the structure.

FIG. 4 illustrates the formation of the downwash vortex 67. The downwash 66 impinges on the floor 20 to cause the downwash vortex 67 which aids in forming the scour hole 24. The downwash vortex 67 is believed to be formed by the upstream flow 62 impinging upon the structure 4 to cause the downwash 66. The downwash 66 impacts upon the floor 20 at the base of the structure 4 to cause the rolling effect associated with the downwash vortex 67. The shedding vortices 70 (see FIG. 2) are sections of the downwash vortex 67 that have separated to pass by the structure 4.

FIGS. 2, 3 and 4 describe the flow characteristics around the structure 4. As previously discussed (see FIG. 3), the water is under high pressure on the upstream side 6 of the structure 4. The flow tends to stabilize by the water rolling around the sides of the structure 4 to create the increased side velocity 64. However, the pressure decrease associated with the increased side velocity 64 is not totally sufficient to lower the high pressure on the upstream side 6 of the structure 4. Thus, the downwash 66 is caused to progress down the upstream side 6. The downwash 66 flows down the upstream side 6 of the structure 4 with velocity and energy that can be expressed as functions of the following: the velocity of the upstream flow 62, the geometry of the structure 4, the velocity profile 63, and the pressure difference along the upstream side 6 of the structure 4 between lower and upper portions of the upstream flow 62.

The downwash vortex 67 impinges upon the loose sediment of the floor 20 dislodging the impacted floor sediment and creating the scour hole 24 on the upstream side 6 of the structure 4. The loose sediment of the floor 20 receiving sufficient energy from the downwash vortex 67 is disengaged from the floor 20 and transported by the increased side velocity 64 and the shedding vortices 70 around the structure 4. Transport of the suspended sediment 30 is aided by the upwash vortex 69 associated with the upwash 68. Thus, the shedding vortices 70 have an uplifting effect which tends to enhance the transport of the suspended sediment 30.

As shown in FIG. 4, the suspended sediment 30 is transported around the structure 4. Some of the suspended sediment 30 collides with the undisturbed sediment 32. The grain-grain interaction caused by the impingement of the suspended sediment 30 against the undisturbed sediment 32 aids to further increase the amount of suspended sediment 30. Thus, the scour hole 24 further increases in size.

In general, the scour hole 24 develops deeper on the upstream side 6 of the structure 4. The deeper segment of the scour hole 24 on the upstream side 6 is caused by the higher energy conditions which exist on the upstream side 6. The characteristics associated with the upstream flow 62 are regained at some distance downstream from the structure 4. The upwash vortex 69 and the shedding vortices 70 aid in the formation of the wake downstream of the structure 4. When the energy is dissipated from the upwash vortex 69 and the shedding vortices 70, the suspended sediment 30 is dropped from the water 60 to form the sediment bar 26 (see FIG. 2). Generally, the sediment bar 26 is formed parallel to the upstream flow 62 and contained within the downstream wake.

Figure 5:
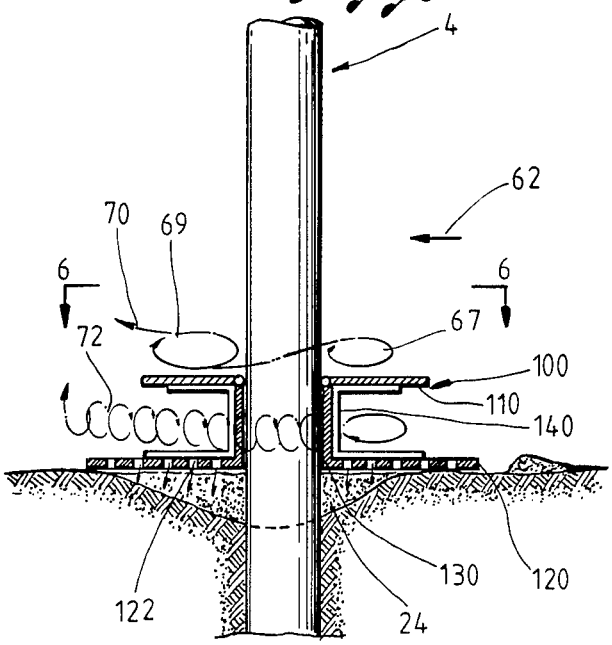
FIG. 5 is a cross-sectional view showing a perspective of a preferred embodiment of the anti-scour apparatus of the present invention.

A preferred embodiment of the anti-scour apparatus of the present invention is illustrated in FIG. 5. The anti-scour apparatus 100 is simple in design, construction and operation. The apparatus 100 consists essentially of two horizontal deflectors, an upper deflector 110 and a lower deflector 120 separated by and supported by a cylindrical sleeve 130. The sleeve fits around the structure 4. The fit of the sleeve 130 around the structure 4 may be loose to allow movement of the structure 4.

The primary effect of the upper deflector 110 is to prevent the impingement of the downwash 66 on the loose sediment of the floor 20. Also, the upper deflector 110 forces the development of the downwash vortex 67 to impact upon and be swept off of the upper surface of the upper deflector 110.

The lower deflector 120 is placed in contact with the loose sediment of the floor 20. The lower deflector 120 prevents the increased side velocity 64 from dislodging and transporting the sediment from the floor 20. In addition, the lower deflector 120 also contributes to preventing the downwash vortex 67 from impinging on the loose sediment of the floor 20.

The sleeve 130 provides a means for separating the upper deflector 110 from the lower deflector 120. The sleeve 130 also provides an attachment source for the plurality of spines 140.

The spines 140 provide an extremely useful part of the present invention. The spines 140 are attached to the sleeve 130 and coincide with the longitudinal axis of the structure 4. The spines 140 are directly attached to the sleeve 130. Specifically, the spines 140 act as hydraulic trips. The flow of water is forced into a turbulent state as the flow passes by and is tripped by the spines 140. The spines 140 function much like dimples on a golf ball causing a later separation of the flow than associated with a smooth surface. Any other device for hydraulically tripping the flow adjacent the sleeve 130 would be acceptable, e.g., a baffle, an abrupt extension of the surface, roughening the surface and the like.

The spines 140 reduce the drag on the anti-scour apparatus 100 and the structure 4 as well as reduce the size and intensity of the wake downstream of the structure 4. Therefore, near the floor 20, the downwash vortex 67 and the shedding vortices 70 are drastically reduced in intensity and can not substantially contribute to scour. The resultant flow is the rolling vortices 72. The vortices 72 are initiated after the flow impacts the sleeve 130 of the anti-scour apparatus 100. The flow is tripped by the spines 140 to induce turbulent flow and to cause an overall smoother, less detectable passage of the flow around the structure 4.

As shown in FIGS. 5, 6, 7A, 8A and 8B, the lower deflector 120 has a series of perforations 122. The perforations 122 are provided to capture the suspended sediment 30 as it passes above the lower deflector 120 and below the upper deflector 110. Since the flow around the structure 4 is delayed from separating due to the spines 140, the capture of suspended sediment 30 in the perforations 120 is significant. Therefore, the suspended sediment 30 captured by the perforations 122 in the lower deflector 120 aid in repairing any existing scour hole 24 that might have been present prior to the utilization of the anti-scour apparatus 100. Furthermore, the formation of the downstream sediment bar 26 (see FIG. 2) is significantly reduced in size by the resulting flow structure.

Generally, the nature of the anti-scour apparatus 100 is to "break-up" the flows which cause scour. Additionally, any sediment suspended independently by the upstream flow 62 will be swept away by either the rolling vortices 72 or the shedding vortices 70. Thus, the device is self-cleaning.

Figure 6:
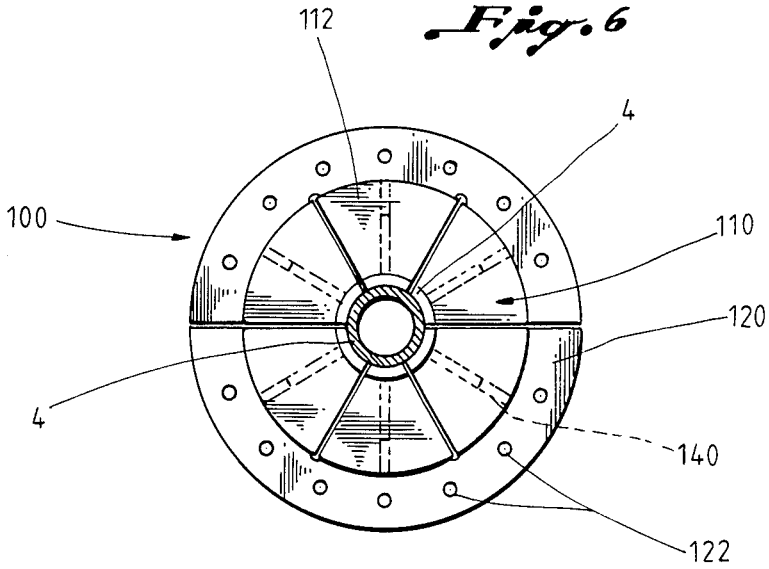
FIG. 6 is a plan view of the anti-scour apparatus taken along the section line 6—6 in FIG. 5.

FIG. 6 is a plan view taken along the section line 6—6 in FIG. 5 of a preferred embodiment of the anti-scour apparatus 100 with the upper deflector 110 divided into movable sections 112. The structure 4 is shown at the center of FIG. 6 around which the anti-scour apparatus 100 may be fixedly or loosely placed. The lower deflector 120, having a larger radius than the upper deflector 110, is shown protruding from beneath the upper deflector 110. The perforations 122 are visible in the part of the lower deflector 120 extending beyond the upper deflector 110. The upper deflector 110 is shown to have six movable sections 112. The movable sections 112 are supported by the spine supports 146 which are horizontal extensions of the spines 140.

Figure 7A:
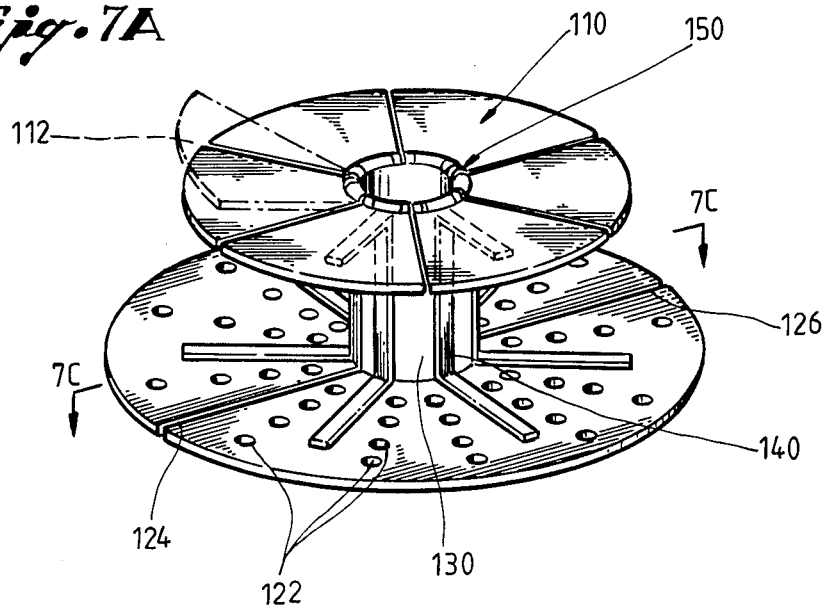
FIG. 7A is a perspective view of a preferred embodiment of the anti-scour apparatus of the present invention illustrating the movable sections of the upper deflector.

FIG. 7A is a perspective view of a preferred embodiment of the anti-scour apparatus 100 illustrating a movable section 112 of the upper deflector 110. Each movable section 112 of the upper deflector 110 is movably secured to the sleeve 130 by any conventional attachment means 150.

FIG. 7A provides a view of the attachment of the lower deflector 120 to the sleeve 130. The lower deflector 120 is attached to the sleeve 130 by use of the spines 140. Also, FIG. 7A provides a better perspective of the perforations 122 in the lower deflector 120.

Figure 7B:
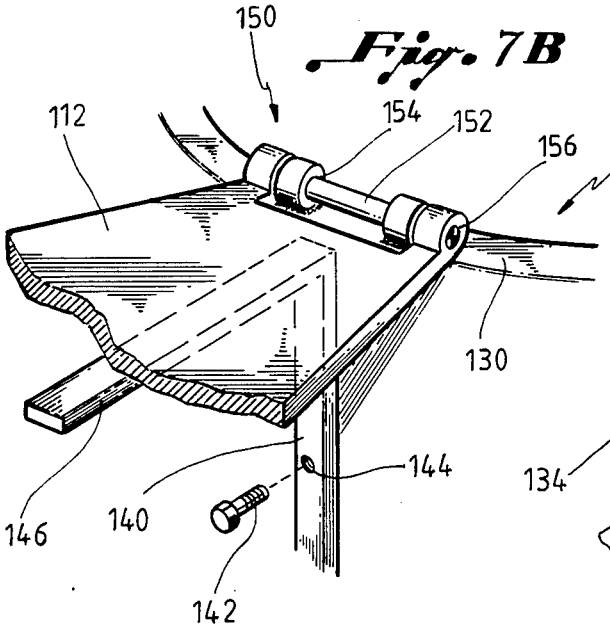
FIG. 7B is a detailed, partial-sectional view of one movable section of the upper deflector.

Shown in FIG. 7B is a detailed partial-sectional view of a movable section 112 of the upper deflector 110. The movable section 112 is attached to the sleeve 130 by the attachment means 150. The attachment means 150 consists essentially of two pairs of sockets 154 and 156, and a pin 152. The sockets 156 are built as part of or fixedly attached to the movable section 112. The sockets 154 are affixed to the sleeve 130. The sockets 154 fit interior of the sockets 156. The socket configuration consists of sockets 154 and 156 which accept the pin 152 to movably attach the section 112 to the sleeve 130. The movable section 112 is held horizontal by the spine support 146. The spine support 146 is the horizontal extension of a spine 140. The spine 140 is fixedly secured to the sleeve 130 by a bolt 142 passing through a hole 144 in the spine 140.

Figure 7C:
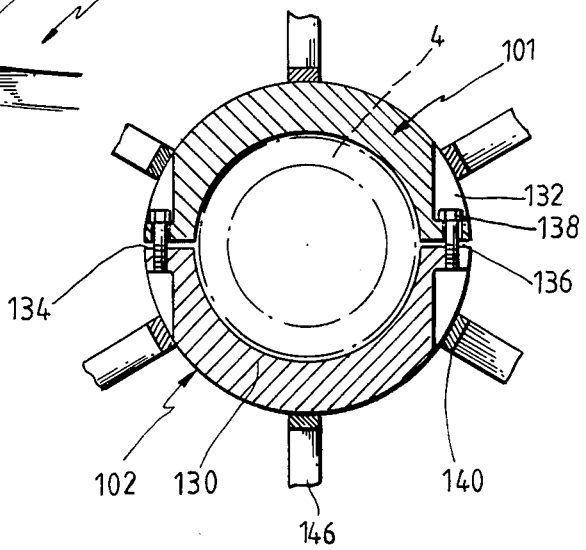
FIG. 7C is a cross-sectional view taken along the section line 7C—7C in FIG. 7A showing a plan view of the sleeve.

FIG. 7C is a cross-sectional view taken along the section line 7C—7C in FIG. 7A showing a plan view of the sleeve 130 and the configuration for attaching the sleeve 130 to the structure 4. The sleeve 130 is shown with the spines 140 and the spine supports 146 attached thereto. The sleeve 130 may be easily disassembled to provide for installing the anti-scour apparatus 100 to a previously built structure 4. The sleeve 130 and the lower deflector 120 are fixedly secured together by the spines 140 and the spine supports 146, as illustrated in FIG. 7A. The spines 140 and the spine supports 146 join the sleeve 130 to the lower deflector 120 to provide alignment between the separation 124 (see FIG. 7A) in the lower deflector 120 and the separation 134 in the sleeve 130, and the separation 126 (see FIG. 7A) in the lower deflector 120 and the separation 136 in the sleeve 130. The separations 124, 126, 134 and 136 provide that the apparatus can be physically separated into two sections, 101 and 102, respectively. The apparatus sections 101 and 102 are fixedly secured together by the use of recesses 132 in the sleeve 130 and the bolts 138.

The anti-scour apparatus 100 can be submerged as two apparatus sections 101 and 102. Commercial divers can then manually adjoin the two apparatus sections 101 and 102 using the bolts 138 to assemble a completed anti-scour apparatus 100.

It should also be understood that when a structure is originally constructed it would be exceedingly easy to include into the manufacture of the structure the anti-scour protector 100 of the present invention. The utilization of the present invention with newly implanted structures would greatly enhance the effectiveness of the anti-scour apparatus.

Figure 8A:
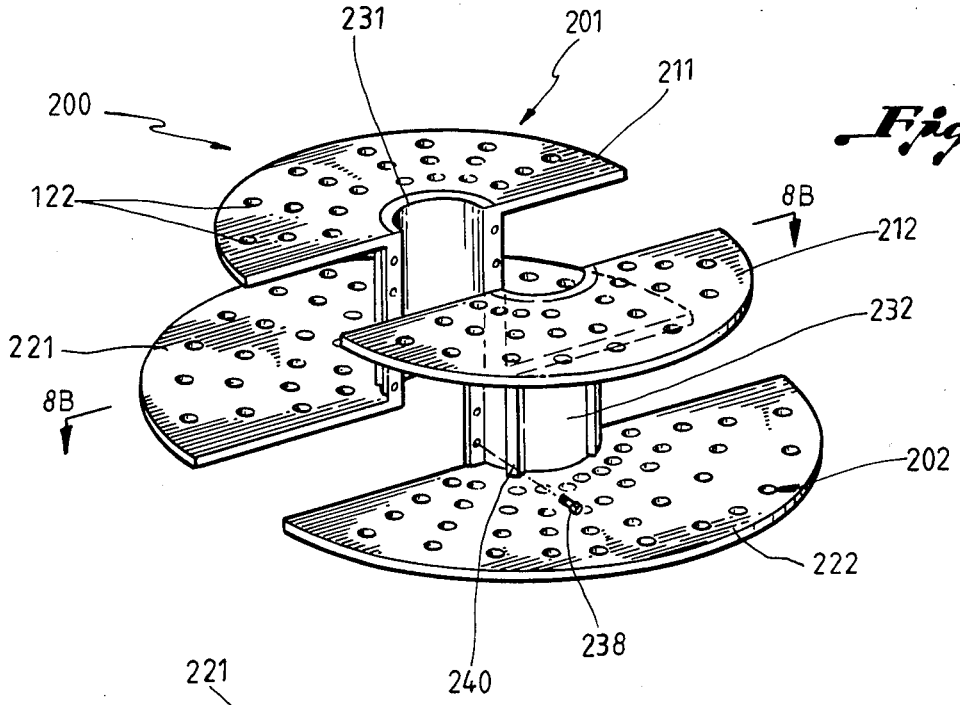
FIG. 8A is a perspective view of a preferred embodiment of a molded anti-scour apparatus of the present invention.

FIG. 8A is a perspective view of a fiberglass molded anti-scour apparatus 200. The fiberglass molded apparatus 200 has a first molded half 201 and a second molded half 202. The first molded half 201 has an upper deflector 211 and a lower deflector 221 connected by a sleeve 231. The second molded half 202 has an upper deflector 212 and a lower deflector 222 connected by a sleeve 232. Sleeve 231 and 232 have spines 240 molded longitudinally to their exterior.

Figure 8B:
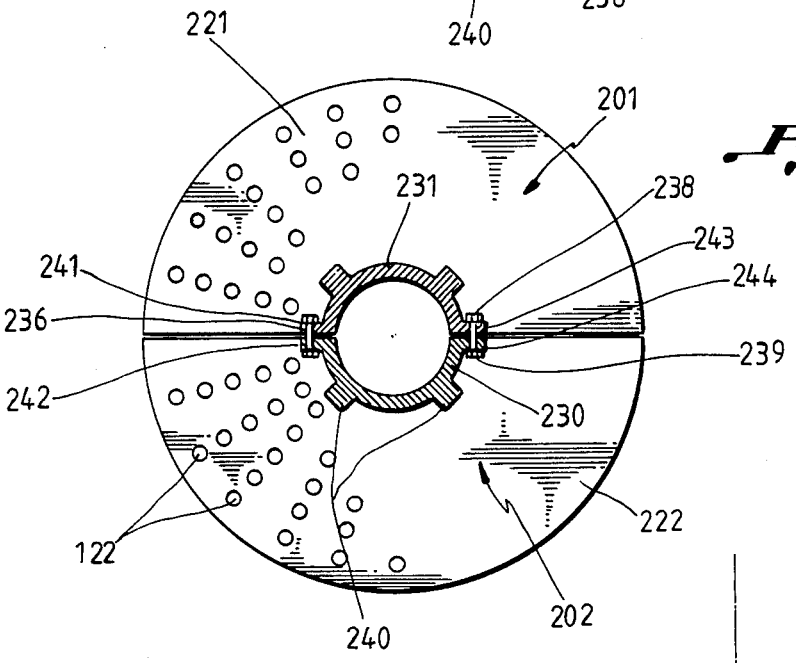
FIG. 8B is a cross-sectional view taken along section line 8B—8B in FIG. 8A illustrating the joining of the sections of the molded anti-scour apparatus.

FIG. 8B is a cross sectional view taken along the section line 8B—8B in FIG. 8A. FIG. 8B illustrates the joining of the first molded half 201 and the second molded half 202. The segmented spines 241 and 242 are joined by fiberglass bolts 238 and fiberglass nuts 239. Likewise, segmented spines 243 and 244 are joined by fiberglass bolts 238 and fiberglass nuts 239.

Figure 8C:
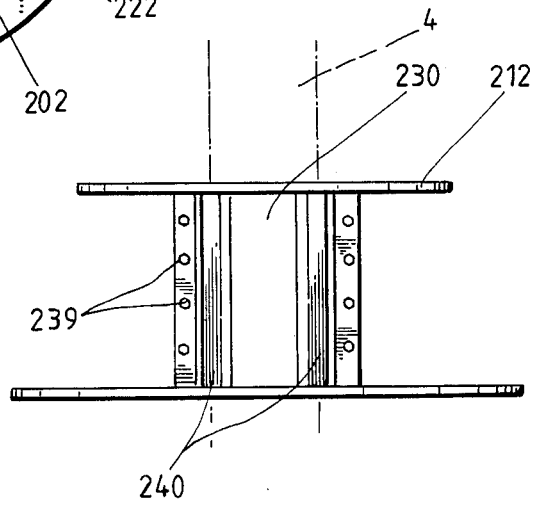
FIG. 8C is an elevation view of the molded anit-scour apparatus as shown in FIG. 8A.

FIG. 8C is an elevation view of the fiberglass molded apparatus 200. FIG. 8C illustrates the use of holes 236 in the segmented spines 242 and 244 which accept the fiberglass bolts 238. The use of an all fiberglass apparatus eliminates corrosion problems as well as providing an extremely durable and effective material.

The present invention is exceedingly easily adapted, as another embodiment, to be utilized from an assembly of components, i.e., assembled from a kit of parts. An assemblage of components can be connected to form the anti-scour apparatus of the present invention. The combination of components can be assembled on the surface of the water, under the water or on land and shipped to the site for use. When the anti-scour apparatus of the present invention is assembled on the surface of the water, the components can be associated with the structure to allow the apparatus to slide downwardly around the structure to engage the floor beneath the body of water. Similarly, an apparatus assembled on land and shipped to the site for use can be associated with the structure to allow the apparatus to slide downwardly around the structure. To assemble the anti-scour apparatus underwater would eliminate the problems of rough water. Divers can be used to assemble the various components as they are lowered from a surface vessel.

A combination of components adapted for assembly together as an anti-scour apparatus can include as cooperative parts thereof: one or more deflectors placed in the vicinity of the structure, one or more members for maintaining the positional relationship of the deflectors between each deflector and the floor beneath the body of water, and a device for inducing turbulent flow in the vicinity of the structure.

The deflectors could include generally circular plates. However, any deflecting means would be acceptable. For example, a deflector might include a device for releasing air bubbles to obstruct the downward flow adjacent a structure. Similarly, a device for creating streams of water perpendicular to the longitudinal axis of the structure could be utilized. Any device or method for deflecting the downwardly flow adjacent the structure can be used to practice the present invention.

The positional relationship of the deflectors can be maintained by a sleeve. However, any structural means or device can be used to adequately separate the deflectors. The most feasible device would be based upon the type of deflectors used. The sleeve can be a physical structure or can be merely encompass the displacement of one deflector device from the other deflector device.

A device for inducing turbulent flow in the vicinity of the structure is generally described as a hydraulic trip. A hydraulic trip includes any device that initiates a turbulent flow in the vicinity of the structure. Such a device might be longitudinally spaced spines, a roughened surface along the structure, or a plurality of randomly associated protrusions on the surface of the structure. The device for inducing turbulent flow can be directly associated with the structure or associated with a component engaged with the structure.

The present invention is exceedingly practical, as an additional embodiment, when applied as a method for preventing scour. The method includes deflecting a downwash caused by the impact of the water on a structure, capturing mobile floor sediment for filling voids on the floor caused by prior scour in the vicinity of the structure and inducing the turbulent flow of water passing adjacent the structure for delaying the separation of the water flow which reduces the magnitude of the drag on the structure and which reduces the size of the weight downstream of the structure.

Preferably, deflection of the downwash is at two locations. First, deflection of the downwash is accomplished adjacent the structure and above the floor beneath the body of water. The first deflection can be accomplished by any device or means for preventing the downwardly flow of the water adjacent the structure. Second, the downwash is defected at a location adjacent the structure and adjacent the floor. The distance between the first deflection and the second deflection is determined by the quantity of the downwash caused by the impact of the water on the structure.

The mobile floor sediment is captured using voids in the bottom of a plate encircling the structure and engaged with the floor beneath the body of water. The plate can be the second deflecting device or can be associated with the second deflecting device. The plate for capturing mobile floor sediment has a plurality of perforations for accepting the mobile sediment as it falls through the perforations due to gravitational attraction. The plate allows for repairing prior scour in the vicinity of the structure.

The inducement of turbulent flow adjacent the structure can be accomplished by any device that acts as a hydraulic trip. A hydraulic trip can be any protrusion or indentation in the surface or associated with the surface which disturbs the laminar flow characteristics of the fluid. Therefore, any device that disturbs the laminar flow characteristics of the fluid is readily usable in the method of the present invention.

Additional advantages and modification will readily occur to those skilled in the art. The invention in its broader aspects is therefore not limited to the specific details, representative method and apparatus described herein. Accordingly, departures may be made from the detail without departing from the spirit or scope of the disclosed general inventive concept.

What is claimed is:

1. An anti-scour apparatus for preventing, reducing or repairing scour in the vicintiy of a structure extending upwardly from the floor beneath a body of moving water comprising:

(a) one or more deflectors in the vicinity of the structure for deflecting the downwash caused by the impact of the moving water on the structure and for preventing the impact of the downwash on the floor, (b) one or more members for maintaining the positional relationship between each deflector and the floor beneath the body of moving water, and (c) a device for inducing turbulent flow in the vicinity of the structure such that the cooperative action of said deflectors and of said device for inducing turbulent flow simultaneously inhibit the downward vertical flow of the water moving parallel to the structure and enhance the horizontal flow of the water moving perpendicular to and around the structure, respectively.

2. An apparatus as defined in claim 1 wherein there are two or more deflectors and one of said deflectors is adjacent the floor beneath the body of moving water and has dimensions perpendicular to the longitudinal axis of the structure of approximately twice the corresponding dimensions of any of the other deflectors.

3. An apparatus as defined in claim 1 wherein each deflector comprises generally circular plates having an aperture at the center through which the structure extends.

4. An apparatus as defined in claim 1 wherein each deflector comprises generally circular plates having aperture at the center through which the structure extends, one of said circular plates being adjacent the floor beneath the body of moving water and having a diameter approximately twice the diameter of the other circular plates.

5. An apparatus as defined in claim 1 wherein said device for inducing turbulent flow comprises a plurality of hydraulic trips, each hydraulic trip including a vertical spine operatively associated with the structure.

6. An apparatus as defined in claim 1 where each deflector has a plurality of perforations therein.

7. An anti-scour apparatus for preventing, reducing or repairing scour in the vicinity of a structure extending upwardly from the floor beneath a body of moving water comprising:

(a) a lower deflector engaging the floor beneath the body of water and having an aperture through which the structure extends for deflecting the downwash caused by the impact of the moving water on the structure and for preventing the impact of the downwash on the floor, (b) an upper deflector positionally associated with said lower deflector and having an aperture through which the structure extends for deflecting the downwash caused by the impact of the moving water on the structure and for preventing the impact of the downwash on the floor, (c) a sleeve movably and removably engaging the structure, said sleeve fixedly engaging said lower deflector and said upper delector for separating and fixing the relative position of said deflectors, and (d) a device for inducing turbulent flow in the vicinity of the structure such that the cooperative action of said deflectors and of said device for inducing turbulent flow simultaneously inhibit the downward vertical flow of the water moving parallel to the structure and enhance the horizontal flow of the water moving perpendicular to and around the structure, respectively.

8. The apparatus as defined in claim 7 wherein said device for inducing turbulent flow comprises a hydraulic trip.

9. The apparatus as defined in claim 7 wherein said device for inducing turbulent flow comprises a plurality of vertical spines operatively associated with the structure.

10. The apparatus as defined in claim 7 wherein said deflectors are generally circular plates having the aperture at the center thereof.

11. The apparatus as defined in claim 7 wherein, said upper deflector has dimensions perpendicular to the longitudinal axis of the structure of approximatelly one-half the dimensions of said lower deflector.

12. An apparatus as defined in claim 7 wherein said lower deflector has a plurality of perforations therein.

13. An apparatus as defined in claim 7 wherein said upper deflector has a plurality of perforations therein.

14. An anti-scour apparatus for preventing, reducing or repairing scour in the vicinity of a structure extending upwardly from the floor beneath a body of moving water comprising:

(a) a lower deflector of generally circular shape having an upper surface, a lower surface and an aperture at the center thereof through which the structure extends for deflecting the downwash caused by the impact of the moving water on the structure and for preventing the impact of the downwash on the floor, said lower deflector engaging the floor beneath the body of moving water for deflecting the downwash caused by the impact of the water on the structure and for preventing the impact of the downwash on the floor, thereby preventing or reducing scour, and said lower deflector having a plurality of perforations for the capture of mobile floor sediment from above the upper surface of said lower deflector for filling voids beneath said lower deflector caused by prior scour in the vicinity of the structure, thereby repairing scour in the vicinity of the structure, (b) an upper deflector of generally circular shape having an upper surface, a lower surface and an aperture at the center thereof through which the structure extends, said upper eflector having a diameter of approximately one-half the diameter of said lower deflector, said upper deflector having a spaced positional relationship with the floor beneath the body of moving water for deflecting the downwash caused by the impact of the water on the structure and for preventing the impact of the downwash on the floor, thereby preventing or reducing scour, and said upper deflector having a plurality of perforations for dissipating lift forces on the apparatus, (c) a sleeve having an inner surface, an outer surface, an upper orifice and a lower orifice, the inner surface of said sleeve movably and removably engaging the structure, the aperture in said lower deflector concentric with and adjacent to the lower orifice of said sleeve, the aperture in said upper deflector concentric with and adjacent to the upper orifice of said sleeve, (d) one or more members for securing said deflectors to said sleeve, and (e) means for inducing turbulent flow in the vicinity of the structure, said device for inducing turbulent flow comprising a plurality of hydraulic trips, each hydraulic trip including a vertical spine operatively associated with the outer surface of said sleeve for delaying the separation of the water flow which reduces the magnitude of the drag on the structure and which reduces the size of the wake downstream of the structure thereby enhancing the anti-scour characteristics of the apparatus.

15. An anti-scour apparatus for preventing, reducing or repairing scour in the vicinity of a structure extending upwardly from the floor beneath a body of moving water comprising:

(a) means for deflecting a downwash flow adjacent the structure at a location above the floor beneath the body of moving water for preventing the impact of the downwash on the floor, (b) means for deflecting the downwash flow adjacent the structure at the floor beneath the body of moving water for preventing the impact of the downwash on the floor, (c) means for capturing mobile floor sediment for filling voids in the floor caused by prior scour, (d) means for inducing turbulent flow in the vicinity of the structure for delaying the separation of the water flow which reduces the magnitude of the drag on the structure and which reduces the size of the wake downstream of the structure, thereby enhancing the anti-scour characteristics of the protector, and (e) means for dissipating lift forces on the apparatus for preventing vertical movement of the apparatus whereby the cooperative action of said means for deflecting and said means for inducing turbulent flow simultaneously inhibit the downward vertical flow of the water moving parallel to the structure and enhance the horizontal flow of the water moving perpendicular to and around the structure, respectively.

16. The apparatus as defined in claim 15 wherein the means for deflecting the downwash flow adjacent the structure at a location above the floor comprises a generally circular plate deflector having an aperture at the center thereof through which the structure extends.

17. The apparatus as defined in claim 15 wherein the means for deflecting the downwash flow adjacent the structure at the floor comprises a generally circular plate deflector having an aperture at the center thereof through which the structure extends and a diameter approximately twice the effective diameter of said juxtaposed means for deflecting.

18. The apparatus as defined in claim 15 wherein the means for capturing mobile floor sediment further comprises a plurality of perforations in said means for deflecting at the floor which includes a deflector adjacent the structure and adjacent the floor having an upper surface, a lower surface and said plurality of perforations therethrough, said perforations for the capture of mobile floor sediment from above the upper surface for filling voids beneath the lower surface caused by prior scour in the vicinity of the structure.

19. The apparatus as defined in claim 15 wherein the means for inducing turbulent flow comprises a hydraulic trip, said hydraulic trip including a plurality of vertical spines operatively associated with the structure.

20. The apparatus as defined in claim 15 wherein the means for dissipating lift forces comprises a plurality of perforations in said means for deflecting at a location above the floor.

21. A combination of components adapted for assembly together as an anti-scour apparatus for preventing, reducing or repairing scour in the vicinity of a structure extending upwardly from the floor beneath a body of moving water and the components comprising as cooperative parts thereof:

(a) one or more deflectors in the vicinity of the structure, (b) one or more members for maintaining the positional relationship between each deflector and the floor beneath the body of moving water, and (c) a device for inducing turbulent flow in the vicinity of the structure such that the cooperative action of said deflectors and of said device for inducing turbulent flow simultaneously inhibit the downward vertical flow of the water moving parallel to the structure and enhance the horizontal flow of the water moving perpendicular to and around the structure, respectively.

22. A combination of components for an anti-scour apparatus as defined in claim 21 wherein there are two or more deflectors and one of said deflectors is adjacent the floor beneath the body of moving water and has dimensions perpendicular to the longitudinal axis of the structure of approximately twice the corresponding dimensions of any of the other deflectors.

23. A combination of components for an anti-scour apparatus as defined in claim 21 wherein each deflector comprises a generally circular plate having an aperture at the center through which the structure extends.

24. A combination of components for an anti-scour apparatus as defined in claim 21 wherein each deflector is a generally circular plate having an aperture at the center through which the structure extends, one of said circular plates being adjacent the floor beneath the body of moving water and having a diameter approximately twice the diameter of the other circular plates.

25. A combination of components for an anti-scour apparatus as defined in claim 21 wherein said device for inducing turbulent flow comprises a hydraulic trip, said hydraulic trip including a plurality of vertical spines operatively associated with the structure.

26. A combination of components for an anti-scour apparatus as defined in claim 21 wherein each deflector has a plurality of perforations therein.

27. A combination of components adapted for assembly together as an anti-scour apparatus for preventing, reducing or repairing scour in the vicinity of a structure associated with the anti-scour apparatus and extending upwardly from the floor beneath a body of moving water and the components of the anti-scour apparatus comprising as cooperative parts thereof:

(a) an upper deflector having an upper surface, a lower surface and an aperture through which the structure extends, said upper deflector maintaining a spaced positional relationship with the floor beneath the body of moving water for deflecting the downwash caused by the impact of the water on the structure and for preventing the impact of the downwash on the floor, thereby preventing or reducing scour, (b) a lower deflector having an upper surface, a lower surface, and an aperture through which the structure extends and engaging the floor beneath the body of moving water for preventing the impact of the downwash on the floor, thereby preventing or reducing scour, said lower deflector having a plurality of perforations for the capture of mobile floor sediment from above the upper surface of said lower deflector for filling any void beneath said lower deflector caused by prior scour in the vicinity of the stucture, thereby repairing scour around the structure, (c) a sleeve having an inner surface, an outer surface, an upper orifice and a lower orifice, the inner surface of said sleeve movably and removably engaging the structure, the aperture in said lower deflector having a relationship concentric with and adjacent to the lower orifice of said sleeve, the aperture in said upper deflector having a relationship concentric with and adjacent to the upper orifice of said sleeve, (d) one or more members for securing said deflectors to said sleeve, and (e) a device for inducing turbulent flow in the vicinity of the structure for delaying the separation of the water flow which reduces the magnitude of the drag on the structure and which reduces the size of the wake downstream of the structure, thereby enhancing the anti-scour characteristics of the apparatus.

28. A combination of components for an anti-scour apparatus as defined in claim 27 wherein said deflectors comprise generally circular plates having the aperture at the center thereof.

29. A combination of components for an anti-scour apparatus as defined in claim 27 wherein said upper deflector has dimensions perpendicular to the longitudinal axis of the structure of approximately one-half the dimensions of said lower deflector.

30. A combination of components for an anti-scour apparatus as defined in claim 27 wherein said lower deflector comprises a plurality of perforations therein for capturing mobile floor sediment for filling voids in the floor caused by prior scour.

31. A combination of components for an anti-scour apparatus as defined in claim 27 wherein said upper deflector comprises a plurality of perforations therein for dissipating the lift forces on the apparatus.

32. A combination of components for an anti-scour apparatus as defined in claim 27 wherein said means for inducing turbulent flow comprises a hydraulic trip, said hydraulic trip including a plurality of vertical spines operatively associated with the structure.

33. The prevention, reduction or reparation of scour in the vicinity of a structure extending vertically from the floor beneath a body of moving water by a method comprising the steps of:

(a) placing a bottom deflector adjacent the floor beneath the body of moving water and around the circumference of the structure for deflecting the downwash caused by the impact of the water on the structure and for preventing the impact of the downwash on the floor, (b) engaging a sleeve with said bottom deflector, said sleeve longitudinally surrounding the structure, (c) engaging a top deflector with said sleeve in spaced relationship to and above said bottom deflector for deflecting the downwash caused by the impact of the water on the structure and for preventing the impact of the downwash on the floor, (d) inducing turbulent flow in the vicinity of the structure for delaying the separation of the water flow which reduces the magnitude of the drag on the structure and which reduces the size of the wake downstream of the structure, thereby enhancing the anti-scour characteristics of the protector whereby the cooperative action of placing and engaging the deflector and inducing turbulent flow simultaneously inhibit the downward vertical flow of the water moving parallel to the structure and enhance the horizontal flow of the water moving perpendicular to and around the structure, respectively.

34. The prevention, reduction or reparation of scour in the vicinity of a structure extending vertically from a floor beneath a body of moving water by a method comprising the steps of:

(a) deflecting, at a location adjacent the structure and above the floor, a downwash caused by the impact of the water on the structure precluding the impact of the downwash on the floor, thereby preventing or reducing scour, (b) deflecting, at a location adjacent the structure and adjacent the floor, the downwash caused by the impact of the water on the structure precluding the impact of the downwash on the floor, thereby preventing or reducing scour, (c) capturing mobile floor sediment for filling voids in the floor caused by prior scour in the vicinity of the structure, thereby repairing scour in the vicinity of the structure, and (d) inducing the turbulent flow of water passing adjacent the structure for delaying the separation of the water flow which reduces the magnitude of the drag on the structure and which reduces the size of the wake downstream of the structure, thereby enhancing the anti-scour characteristics of the apparatus.

35. A method as defined in claim 34 wherein the steps (a) and (b) comprise deflecting the downwash flow against a plate deflector of generally circular shape and having an aperture at the center thereof through which the structure extends.

36. A method as defined in claim 34 wherein the steps (a) and (b) comprise deflecting the downwash flow adjacent the structure against a first and a second plate deflector of generally circular shape and having an aperture at the center thereof through which the structure extends, said second plate deflector engaging the floor and having a diameter approximately twice the diameter of said first deflector.

37. A method as defined in claim 34 wherein the step of capturing mobile floor sediment comprises using a deflector adjacent the structure and the floor having an upper surface, a lower surface and a plurality of perforations therethrough, the perforations for the capture of mobile floor sediment from above the upper surface for filling voids beneath the lower surface caused by prior scour in the vicinity of the structure.

38. A method as defined in claim 34 wherein the step of inducing turbulent flow comprises hydraulically tripping the flow, a hydraulic trip including a vertical spine operatively associated with the structure.

* * * * *